US005104118A

United States Patent [19]

Hamanaka

[11] Patent Number: 5,104,118

[45] Date of Patent: Apr. 14, 1992

[54] APPARATUS FOR SORTING RECORDING MEDIUMS

[75] Inventor: Izumi Hamanaka, Tokyo, Japan

[73] Assignee: Konica Corporation, Tokyo, Japan

[21] Appl. No.: 668,900

[22] Filed: Mar. 13, 1991

[30] Foreign Application Priority Data

Mar. 14, 1990 [JP] Japan ..... 2-63614

[51] Int. Cl.[5] ..... B65H 39/10

[52] U.S. Cl. ..... 271/297; 271/305

[58] Field of Search ..... 271/297, 305, 300, 287, 271/288, 298

[56] References Cited

U.S. PATENT DOCUMENTS 4,012,034 3/1977 Nelson ..... 271/297 X
4,494,748 1/1985 Miyashita et al. ..... 271/297 X
5,013,028 5/1991 Tajima et al. ..... 271/305

FOREIGN PATENT DOCUMENTS 2042477 9/1980 United Kingdom ..... 271/305

*Primary Examiner*—David H. Bollinger
*Attorney, Agent, or Firm*—Finnegan, Henderson, Farabow, Garrett & Dunner

[57] ABSTRACT

An apparatus for sorting recording mediums, the apparatus adapted for use in combination with an image forming device having a transport section for carrying recording mediums discharged from the image forming device, includes a plurality of bins for accommodating the recording mediums, gate members provided one for each bin for opening and closing a transport passage for the recording mediums, and drive devices provided for driving the gate members. The drive devices each consist of a cam mounted on a rotary shaft which may be rotated reversibly for actuating the gate member, and a detection and control section for detecting the position of the cam.

6 Claims, 6 Drawing Sheets

APPARATUS FOR SORTING RECORDING MEDIUMS

BACKGROUND OF THE INVENTION

1. Field of the Invention

The present invention relates to an improvement in a sorting apparatus which is combined with an image forming apparatus to sort out recording mediums discharged from the image forming apparatus.

2. Description of the Prior Art

Generally a sorter 10 is used in combination with an image forming apparatus 1 as shown in FIG. 2. A transport section 18 in the sorter 10 carries sheets of paper 5 as recording mediums discharged from the image forming apparatus 1 successively to each of an array of bins 20 attached to the sorter 10 so that a specified number of recording sheets 5 are stacked in respective bins 20.

As shown in FIG. 2, the bins 20 attached to the sorter 10 are vertically arrayed at equal intervals and serially numbered from the top down on, with the top bin numbered as a first bin, the next bin as a second bin and so on until the bottom bin as an n-th bin. The recording sheets 5 are sorted out and carried to these bins, beginning with the first bin 20 and ending with the n-th bin 20.

In this kind of sorter 10, a desired number of recording sheets 5 to be sorted out is preset to a CPU 3 in the image forming apparatus 1. According to the control of the CPU 3, the sorter 10 successively performs an open-close operation on a series of gate members provided one to each bin 20 so that the recording paper 5 is carried along the surface of the gate member, which has closed a transport passage of the recording paper 5, into the associated bin 20.

A conventional drive mechanism for opening and closing the gate member consists, as shown in FIG. 8, of a gate member 21, a gate arm 21*d* attached to one end of the gate member, a solenoid 24 engaged with the gate arm 21*d* to pivot the gate member 21, and a switching element and wires to activate the solenoid 24.

As shown in FIG. 7, the recording sheets of paper 5 are carried by the transport section 18, which consists of a belt 14 wound on first paired rollers 12 and a second roller 13 and a group of third rollers 15 arranged on both sides of the belt 14.

When the recording paper 5 is fed along the surface of the gate member 21 for the first bin 20, that has closed the transport passage of the paper 5, into the first bin 20, a detecting section (not shown) sends to the CPU 3 of the image forming apparatus 1 a feedback signal representing that the paper 5 is completely placed in the first bin 20. The CPU 3 now activates the solenoid 24 for the first bin 20 to pivot the associated gate member 21 counterclockwise and thereby open the transport passage of the paper 5 and at the same time drives the solenoid 24 for the second bin 20 to pivot the associated gate member 21 clockwise.

The resultant closing of the transport passage for the recording sheet 5 by the gate member 21 associated with the second bin 20 permits the recording sheet 5 to be introduced along the surface of the gate member 21 into the second bin 20. In this way, the sorter 10 equipped with n bins successively operates the solenoids 24, starting with the one associated with the first bin 20 and ending with the one for the n-th bin 20, to rotate the corresponding gate members 21 and thereby repetitively open and close the recording paper transport passage. This series of operations is repeated a specified number of times to sort out and deliver into each of the bins a required number of sheets 5 which are copies obtained from different documents on the image forming apparatus. As for the n-th bin 20, which is the last bin, the associated gate member 21 is fixed to close the transport passage of the recording sheet 5, so that no solenoid 24 nor switching element is provided.

As mentioned above, the conventional drive mechanisms to open and close the gate members 21 to sort out the recording sheets 5 employ the solenoids 24 and switching elements.

For example, suppose one wants to make twenty copies from each of a plurality of documents with the recording sheets 5. A sorter 10 with twenty bins should be used. This sorter 10 requires 20 gate members 21 for the bins 20, and 19 solenoids 24, 19 switching elements and associated wiring to drive the gate members 21. Since many expensive solenoids 24 and switching elements as well as a large printed circuit card and complex wiring connecting these components must be assembled and installed, a number of manufacturing processes are required.

Because the drive mechanisms that open and close the gate members 21 to sort out the recording sheets 5 require expensive components and a number of manufacturing processes, the overall manufacturing cost of the sorter 10 necessarily increases.

SUMMARY OF THE INVENTION

This invention has been accomplished to overcome the above-mentioned drawback and to provide an apparatus of sorting recording mediums in which the gate drive mechanism has a simple construction consisting of inexpensive components and which performs operation with a level of reliability equal to or higher than that of the conventional sorter.

An object of this invention is to provide an apparatus of sorting recording mediums for being used in combination with an image forming device having a transport section for carrying said recording mediums discharged from said image forming device, said apparatus comprising:

a plurality of bins for accommodating said recording mediums discharged from said image forming device;

a plurality of gate members for opening and closing a transport passage of said recording mediums so that said recording mediums are accommodated in said bins;

a plurality of actuating members for actuating said gate members respectively;

a plurality of cam members for pivoting said actuating members respectively; and a control means for controlling said cam members so that a first recording medium of said recording mediums is accommodated in a predetermined bin of said bins.

These and other objectives and features will become apparent from the following description taken in conjunction with the accompanying drawings.

BRIEF DESCRIPTION OF THE DRAWINGS

FIG. 3(*b*) is a side view showing the gate member in action;

FIG. 5(*b*) is a sectional side view of the interaction of the disc cam and an actuating member;

FIG. 6(*b*) is a side view of the cam mechanism of FIG. 6(*a*);

PREFERRED EMBODIMENT OF THE INVENTION

Figure 1:
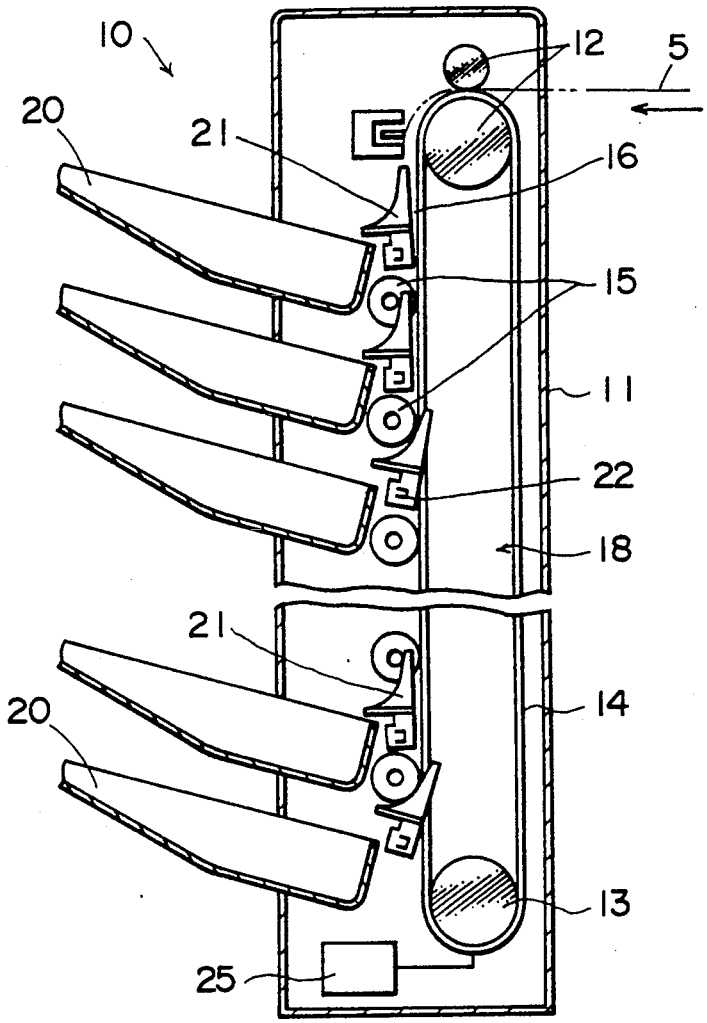
FIG. 1 is a sectional side view of a transport section and a gate mechanism of a sorting apparatus as one embodiment of this invention.
Figure 2:
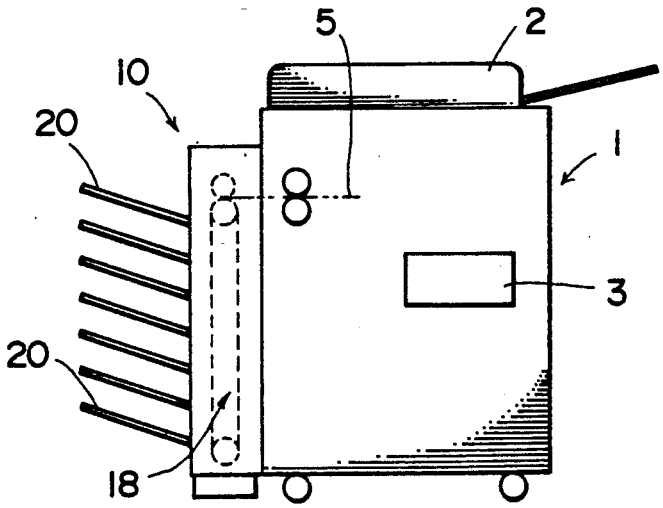
FIG. 2 is a side view of the sorting apparatus and an image forming apparatus combined.
Figure 3A:
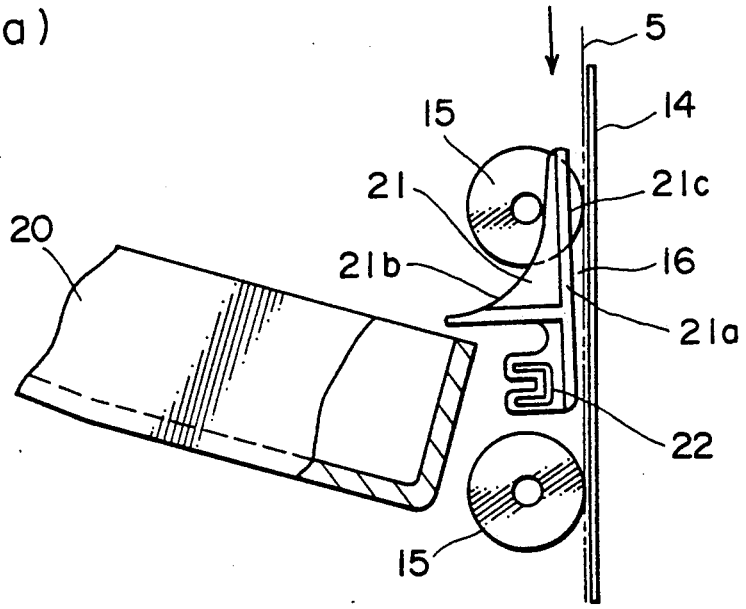
FIG. 3(*a*) is a side view showing the details and arrangement of a gate member according to the embodiment of this invention.
Figure 3B:
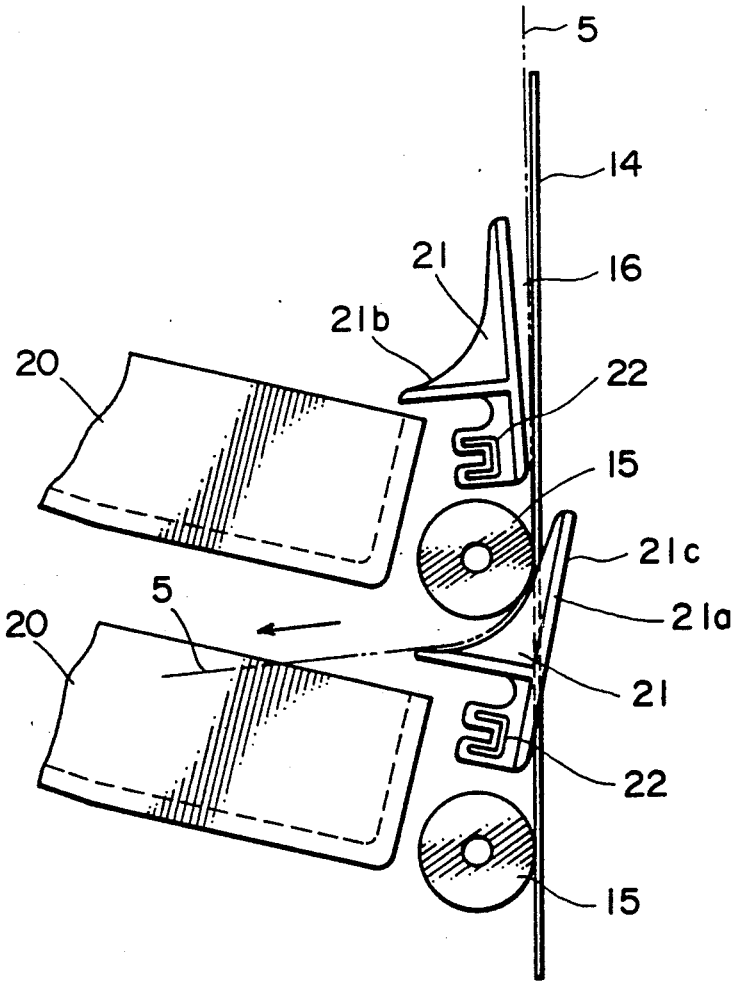
Figure 4:
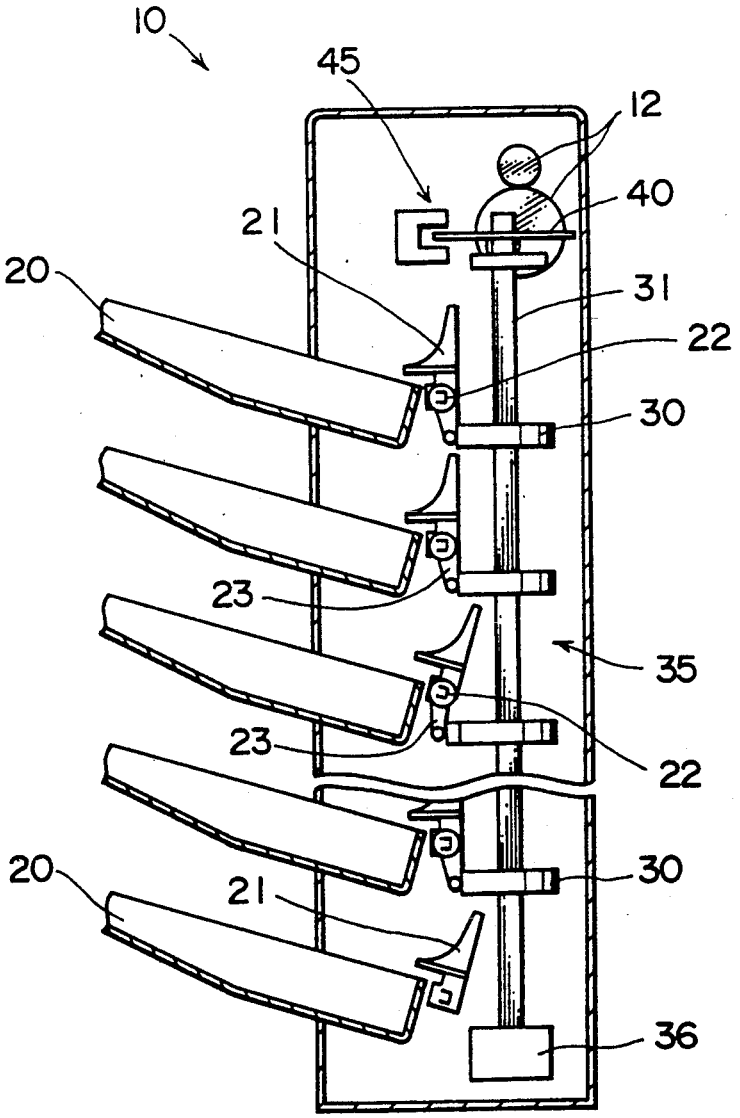
FIG. 4 is a side view of a cam mechanism according to the embodiment of this invention.
Figure 5:
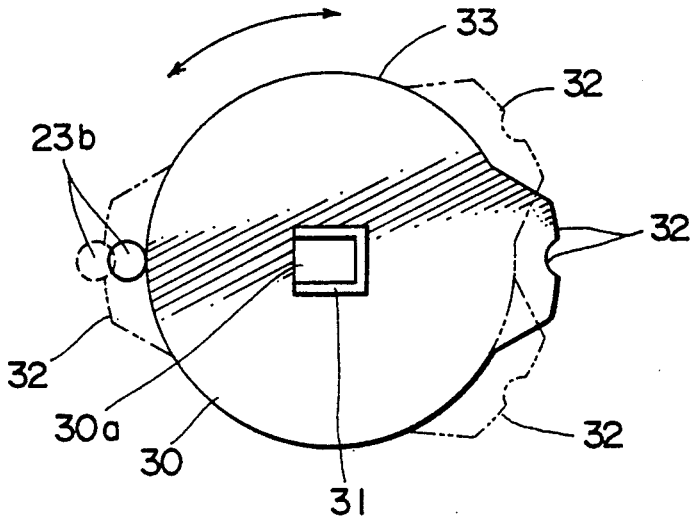
FIG. 5(*a*) is a plan view showing the details of a disc cam according to the embodiment of this invention.
Figure 5:
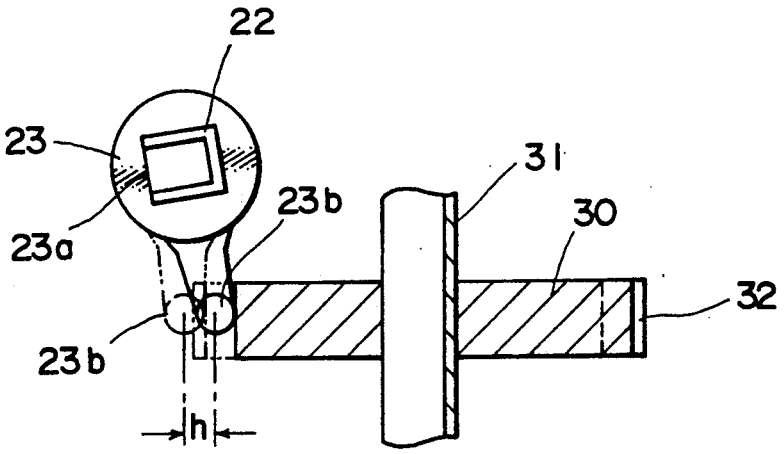
Figure 6A:
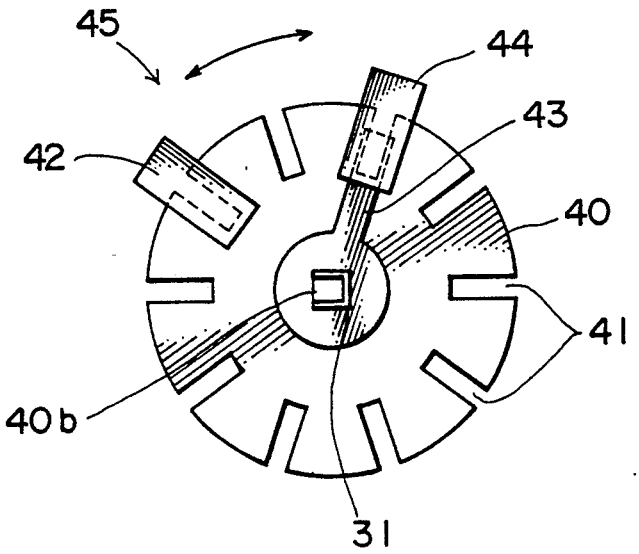
FIG. 6(*a*) is a plan view of a detection and control section of the cam mechanism according to the embodiment of this invention.
Figure 6B:
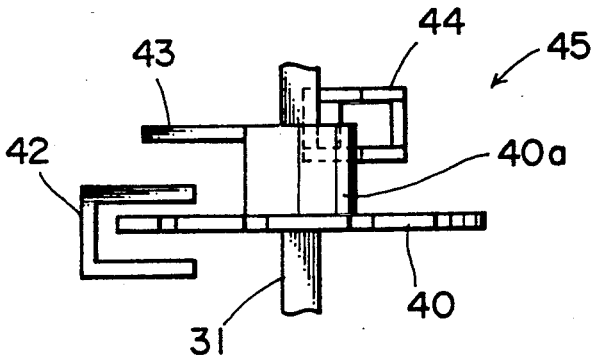
Figure 7:
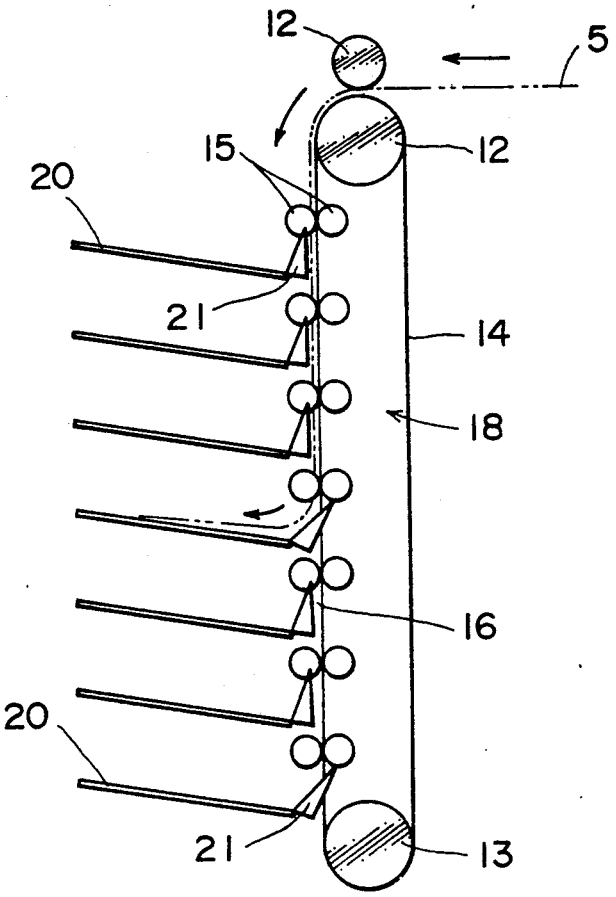
F I G . 7 PRIOR ART
FIG. 7 is a side view of a transport section and gate members of a conventional apparatus.
Figure 8:
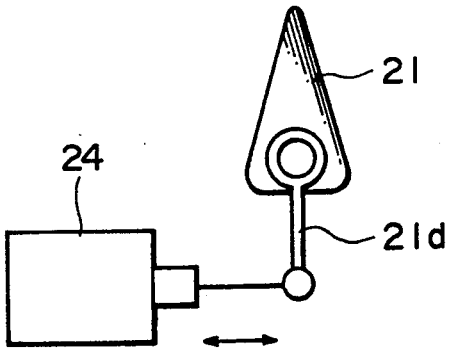
F I G . 8 PRIOR ART
FIG. 8 is a side view showing the shape of the conventional gate member and its relationship with a solenoid.

One embodiment of this invention will be described by drawings. FIG. 1 is a sectional side view of the transport mechanism and gate mechanism of a sorting apparatus; FIG. 2 is a side view showing the sorting apparatus mounted to an image forming apparatus; FIG. 3(*a*) is a side view showing the details and arrangement of the gate member; FIG. 3(*b*) is a side view showing the gate member in action; FIG. 4 is a side view of a cam mechanism; FIG. 5(*a*) is a plan view showing the details of a disc cam; FIG. 5(*b*) is a sectional side view of the interaction of the disc cam and its actuating member; FIG. 6(*a*) is a plan view showing a detecting and control section of the cam mechanism; and FIG. 6(*b*) is a side view of FIG. 6(*a*).

It should be noted, however, that the present invention is not limited to this embodiment alone. Components that have the same functions as those of the conventional components are given like reference numerals.

The major mechanism of a sorter 10 according to this invention, as shown in FIGS. 1 and 4, consists of: a transport section 18 for carrying recording mediums or recording sheets of paper 5; a number of bins 20 for accommodating the recording paper 5; a gate member 21 corresponding to each of the bins 20, drive mechanisms each consisting of an actuating member 23 and a cam mechanism to rotate the associated gate member 21; and a detection and control section 45 for detecting the position of a cam mechanism 35 for control.

In FIG. 1, the transport section 18 in the sorter 10 has a pair of first rollers 12 installed in the upper portion of the sorter 10 to receive a sheet of recording paper 5 discharged from an image forming apparatus 1 and to feed it into the sorter 10. A second roller 13 is installed at the lower part of the sorter 10, i.e., on the far side from the first rollers 12. An endless belt 14 is engaged with the lower one of the first paired rollers 12 and with the second roller 13 so that the belt 14 travels in the upward and downward directions. A series of third rollers 15 are provided one for each bin 20 in such a manner that they contact the surface of the belt 14, extend perpendicular to the direction of belt travel and are rotatably supported on the sides of a housing 11. The third rollers 15 therefore rotate while in contact with the surface of the belt 14.

In an intermediate portion of the sorter 10, the belt 14 and the third rollers 15 are arranged opposite to each other. A transport passage 16 for the recording paper 5 is formed between the left side of the belt 14 and the surfaces of the third rollers 15 in contact with the belt 14 and between the left side of the belt 14 and the right side surface of each gate member 21.

The transport section 18 is driven by a drive source 25.

According to the specifications of the above-mentioned sorter, a specified number of bins 20 for accommodating the recording paper 5 are arranged vertically at equal intervals on the sorter 10, with the first bin 20 positioned at the top and the last n-th bin 20 at the bottom. The bins 20 are secured at their right end to the frame of the sorter 10 and inclined at specified angles with respect to the housing 11. The box-shaped bins 20 are each open at the top, so that the recording paper 5 fed in by the transport section 18 is carried along the surface of the gate member 21 into the bin 20 from above.

The gate member 21 is a plastic molding and, as shown in FIGS. 3(*a*) and 3(*b*), consists of: a boss at the lower part having a square hole that receives a gate rotating shaft 22; and a laterally elongate, rectangular gate piece 21*a* above the boss, both formed integral as one piece. The gate piece 21*a* has ribs 21*b* with a curved surface on the left side facing the bin 20 and, on the right side facing the belt 14, a flat portion 21*c* so that as detailed later, the recording paper 5 is carried along the curved surface of the ribs 21*b* into the bin 20 as indicated by the arrow.

The gate members 21 are mounted on the gate rotating shafts 22 provided at the positions corresponding to the respective bins 20, and are arranged in the central part of the sorter 10 between the right end of the bins 20 and the left side of the belt 14.

The gate members 21 supported by the rotating shafts 22 are urged by a spring not shown to rotate counterclockwise to open the transport passage 16 for the recording paper 5. Thus the flat portion 21*c* of the gate member 21 is situated almost parallel to the surface of the belt 14 with a gap therebetween, allowing the recording paper 5 to move past the gate member 21 downwardly.

The gate member 21 for the bottom bin 20 is rigidly mounted to the frame of the sorter 10 in such a way as to close the transport passage 16, as mentioned earlier. The actuating member 23 that rotates the associated gate member 21 is a plastic molding, shaped like an arm, which consists of: a boss at the upper portion formed with a square hole 23*a* that receives the gate rotating shaft 22; and a global contact piece 23*b* at the lower portion, both formed as one piece, as shown in FIG. 5(*b*). The actuating member 23 is mounted beside the gate member 21 on the same gate rotating shaft 22 on which the gate member 21 is mounted, so that the actuating member 23 and the gate member 21 are pivoted together. The gate member 21 for the bottom bin 20 is not provided with the actuating member 23.

In FIG. 4 and FIGS. 5(*a*) and 5(*b*), a disc cam 30 that operates the actuating member 23 is a plastic molding, which has a square hole 30*a* at the center that receives a disc cam rotating shaft 31. A circumferential surface 33 of the disc cam 30 forms a contact surface with which the contact piece 23*b* is kept in sliding contact.

As shown in FIG. 5(*a*), the disc cam 30 is formed with a cam 32 projecting from one part of the circumferential surface 33. A difference h in height between the cam 32 and the circumferential surface 33 constitutes a cam stroke.

The disc cams 30 thus formed are mounted on the disc cam rotating shaft 31 rotatably supported by support blocks at the upper and lower part of the housing 11. These disc cams 30 on the shaft 31 are positioned at equal intervals at locations corresponding to the respective gate members 21, starting from the top gate member 21 for the first bin 20 down on. The bottom gate member 21 does not need the disc cam 30.

The actuating member 23 that is pivoted together with the gate member 21 has its contact piece 23*b* in contact with the circumferential surface 33 of the disc cam 30 with a certain pressing force. The disc cam rotating shaft 31 can be driven either in the forward or reverse direction by a drive source 36.

The cam positions on the disc cams 30 for the respective bins 20 vary depending on the number of bins equipped in the sorter 10. For example, in the case of the above sorter 10 having ten bins 20, the circumference of the disc cam 30 is divided into ten equal sections. And the cam position is successively shifted one circumferential section or 36 degrees with respect to the square hole 30*a* to prepare nine disc cams 30, each of which has the cam formed at a different position along the circumference 33. These disc cams 30 are mounted and positioned on the shaft 31 in the following manner. The disc cam 30 for the actuating member 23 that corresponds to the first bin 20 is so positioned that the interaction between the contact piece 23*b* of the actuating member 23 and the cam 32 causes the gate member 21 to pivot clockwise closing the transport passage 16. The disc cam 30 for the second bin 20 has its cam 32 shifted 36 degrees in the counterclockwise direction from the cam 32 of the disc cam 30 for the first bin 20 and is then mounted on the shaft 31. Because the contact piece 23*b* is positioned on the circumferential surface 33 of the disc cam 30 for the second bin 20, the gate member 21 for the second bin is so positioned as to open the transport passage 16. In this way, the following disc cams 30 for the third to ninth bins 20 that have their cams 32 successively shifted 36 degrees counterclockwise are mounted on the shaft 31.

Hence, all the gate members 21 except for those associated with the first and tenth bins 20 are so positioned as to open the transport passage 16.

A detection and control mechanism to detect the rotating position of each disc cam 30 for performing control is, as shown in FIGS. 6(*a*) and 6(*b*), comprised of: a sensor disc 40 mounted on the same rotating shaft 31 on which the disc cams 30 are also mounted; a disc cam detecting section 42 for detecting the position of the sensor disc 40; and a home position detecting section 44. The detecting sections 42, 44 each incorporate an optical sensor.

The sensor disc 40 is a black opaque plastic molding, which is formed as one piece with a boss 40*a* that has a square hole 40*b* at the center for accepting the shaft 31, and an actuator 43 for home position detection projecting at a predetermined position from the side of the upper part of the boss 40*a*. The sensor disc 40 is formed with slits 41 at positions corresponding to the dividing lines which, in the case of the sorter 10 with ten bins, divide the surface of the sensor disc 40 into ten equal sections.

As shown in FIG. 4, the sensor disc 40 is located above the disc cam 30 for the first bin 20 and mounted on the common rotating shaft 31 so that the sensor disc 40 is rotated in synchronism with the disc cam 30. The disc cam detecting section 42 is formed like a letter U lying on its side and is secured to a specified portion of the frame of the housing 11 in such a way as to straddle the sensor disc 40.

The detection by the sensor disc 40 of the positions of the disc cams 30 is performed as follows. As the sensor disc 40 is successively rotated 36 degrees clockwise at a time from the position at which the gate member 21 for the first bin closes the transport passage 16, the slits 41 are detected successively and at the same time the disc cams 30 are all rotated 36 degrees at a time. Hence, the interaction between the actuating members 23 and the cams 32, that are shifted 36 degrees from each other, successively causes the gate members 21 to close the transport passage 16, starting with the first bin 20.

A detection signal from the sensor disc 40 and another detection signal indicating that the recording paper 5 has been accommodated into the bin 20 are fed to the CPU, which in turn controls the drive source to rotate the shaft 31 in forward or reverse direction or stop it.

The home position detecting section 44 automatically resets the disc cams 30 when the sorter 10 is operated or when the sorting operation on the recording paper 5 has been completed, so that the gate member 21 for the first bin 20 closes the transport passage 16. This position is the home position of the disc cams 30.

Therefore, the home position is where the sorting on the recording paper 5 is always started from the first bin 20. When the sorting on the recording paper 5 is not needed, the CPU 3 controls the disc cams to the home position so that all of the sheets of paper will be supplied to the first bin 20.

The home position detecting section 44 is shaped like a letter U lying on its side and straddles the actuator 43, as shown. The home position detecting section 44 is rigidly mounted to a specified position on the frame of the housing 11.

The home position for the disc cams 30 is reached when the actuator 43 that rotates with the sensor disc 40 intercepts the home position detecting section 44. When the actuator 43 is at the detecting section 44, the slit 41 in the sensor disc 40 that corresponds to the first bin is detected by the disc cam detecting section 42.

The sensor disc 40 and the detecting sections 42, 44 set in such a relationship combine to determine the home position and cause the gate member 21 for the first bin 20 to close the transport passage 16.

The operation of the sorter 10 constructed as described above which has ten bins will be explained in the following.

When one wants to make ten copies from each of two kinds of documents and sort them out by using the sorter 10 combined with the image forming apparatus 1, as shown in FIG. 2, one sets each of the document in an ADF device 2 attached to the image forming apparatus 1 and then enters the number of copies to be sorted out, that is, "10" from the keyboard of the image forming apparatus 1.

The ADF device 2 then starts discharging the recording papers 5 which are copies of the first document. At the start-up of the sorter 10, the disc cams 30 assume the home position and the gate member 21 for the first bin 20 closes the transport passage 16 for the recording paper 5, so that the recording paper 5 discharged from the ADF device is fed through the first paired rollers 12 and guide plate into the first bin 20.

An optical sensor, though not shown, detects when the recording paper 5 is accommodated in the first bin 20 and then sends a corresponding signal to the CPU 3. The CPU 3 then controls the drive source 36 to rotate clockwise the disc cam rotating shaft 31, on which the disc cams 30 are mounted, causing the sensor disc 40 and the disc cams 30, which were at the home position, to rotate together.

When the sensor disc 40 has rotated 36 degrees, the disc cam detecting section 42 detects the slit 41 corresponding to the second bin 20 and at the same time the rotation of the shaft 31 is stopped. Because the disc cams 30 having already rotated 36 degrees, the gate member 21 for the first bin 20 opens the transport passage 16 and the gate member 21 for the second bin 20 closes that passage 16, allowing the recording paper 5 to move past the first bin gate member 21 and enter into the second bin 20.

The same process occurs for the succeeding bins—the third to ninth bin 20—intermittenly rotating the disc cams 36 degrees at a time by the sensor disc 40 and the detecting section 42. In this way, the recording sheets of paper 5 are successively sorted out and fed into respective bins 20.

The gate member 21 for the tenth bin 20 at the bottom is so set as to close the transport passage 16 at all times. Hence, simply operating the gate member 21 for the ninth bin 20 to open the transport passage 16 will allow the recording paper 5 to be supplied into the 10th bin 20.

When the sorting operation on the recording paper 5 copied from the first document is completed, the document in the ADF device 2 is automatically switched over to the second document.

When the sorter 10 has finished sorting out the ten copies of the first document, it is controlled by the preprogrammed CPU to feed the first sheet of recording paper 5 copied from the second document into the 10th bin 20. The shaft 31 is now rotated in a direction reverse to that in which the shaft was rotated for the sorting of the copies of the first document, operating the associated mechanisms in the reverse order, supplying the recording papers 5 copied from the second document into each of the bins 20, successively from the ninth bin 20 up to the first bin 20. In this way, ten sets of copies of two documents each, copied from two documents, are prepared. The mechanism sections in the sorter 10 are now returned to the home position.

In the above example, we have explained the operation in which all of the bins 20 installed in the sorter 10 are used. It is also possible to sort out five copies with the same sorter 10 by performing the same process.

Any number of copies can be sorted out very quickly by repeating the forward (clockwise) and reverse rotations of the disc cams 30.

As described above, the bin gate driving mechanisms with this invention do not require a large number of expensive solenoids, switching elements and complex wiring, but instead consist mainly of inexpensive plastic moldings and mechanical operation components. This constructure realizes a substantial reduction in cost and offers the same functions as those of the conventional sorter.

EFFECTS OF THE INVENTION

Since the sorter of this invention does not use a large number of expensive solenoids, switching elements and complex wiring as required by the conventional sorter, but mainly employs mechanical components and driving mechanisms formed of plastic moldings, not only is the manufacturing cost greatly reduced but also the sorter can be manufactured in large numbers. Furthermore, the sorter of this invention can perform stable operation as reliably as or more reliably than the conventional sorter.

What is claimed is:

1. An apparatus for sorting recording mediums, the apparatus adapted for use with an image forming device having a transport section for carrying said recording mediums discharged from said image forming device, said apparatus comprising:

an array of bins adapted to receive said recording medium discharged from said image forming device;

a plurality of gate members associated with each of the bins for opening and closing a transport passage for said recording mediums so that said recording mediums may be received in said bins;

a plurality of cam means each having a cam on a peripheral surface thereof, the peripheral surface of each cam being in actuating relationship with a respective one of said gate members;

a rotary shaft, rotatable in a forward and backward direction, on which said cam means are mounted so that respective ones of said cams are arranged at positions different in phase from the others;

a driving means, in driving contact with said rotary shaft, for rotating said rotary shaft in both said forward and backward directions;

a detecting means, rotatably linked to said rotary shaft, for detecting an angular position of one of said cams; and a control means for controlling said driving means to determine the angular positions of said one cam so that a first recording medium of said recording mediums is accommodated in a predetermined bin of said bins and for controlling the rotary direction of said driving means.

2. The apparatus of claim 1, wherein said driving means is a stepping motor.

3. The apparatus of claim 1 further comprising a detecting means for detecting a home position of said rotary shaft.

4. The apparatus of claim 3 wherein said home position detecting means comprises an actuator mounted on said rotary shaft and a sensor arranged at a home position for detecting said actuator.

5. The apparatus of claim 1 wherein said detecting means comprises a disc mounted on said rotary shaft and having slits corresponding in number and position to said cams and a sensor for detecting one of said slits.

6. The apparatus of claim 1 wherein said cam comprises a protruding portion and a concave portion formed in the center of said protruding portion, said concave portion receiving said gate member.

* * * * *